US011721499B2

(12) United States Patent
Hsu et al.

(10) Patent No.: US 11,721,499 B2
(45) Date of Patent: Aug. 8, 2023

(54) BUTTON ASSEMBLY

(71) Applicants: LITE-ON ELECTRONICS (GUANGZHOU) LIMITED, Guangzhou (CN); Lite-On Technology Corporation, Taipei (TW)

(72) Inventors: Kuo-Hui Hsu, Taipei (TW); Cheng-Kun Liao, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 17/540,214

(22) Filed: Dec. 1, 2021

(65) Prior Publication Data

US 2022/0093350 A1 Mar. 24, 2022

Related U.S. Application Data

(62) Division of application No. 16/408,481, filed on May 10, 2019, now abandoned.

(60) Provisional application No. 62/712,993, filed on Aug. 1, 2018.

(30) Foreign Application Priority Data

Dec. 27, 2018 (CN) ..... 201811609150.7

(51) Int. Cl.
*H01H 13/14* (2006.01)
*H01H 13/20* (2006.01)

(52) U.S. Cl.
CPC ..... *H01H 13/14* (2013.01); *H01H 13/20* (2013.01); *H01H 2221/062* (2013.01)

(58) Field of Classification Search
CPC .. H01H 13/14; H01H 13/20; H01H 2221/062; H01H 3/125; H01H 13/7065; H01H 13/84; H01H 13/85
See application file for complete search history.

(56) References Cited

U.S. PATENT DOCUMENTS 8,492,669 B2 * 7/2013 Yen ..... H01H 3/122 200/344
11,177,084 B1 * 11/2021 Liu ..... H01H 3/125
2020/0043678 A1 * 2/2020 Hsu ..... H01H 13/14

* cited by examiner

*Primary Examiner* — Lheiren Mae A Caroc
(74) *Attorney, Agent, or Firm* — JCIPRNET

(57) ABSTRACT

A button assembly includes a bottom plate, a cap, an elastic member, a link member, and an interference member. The cap is disposed on the bottom plate, and the cap has a button surface and an inner surface relative to each other. The elastic member is disposed under the cap. The link member has two parallel portions parallel to each other and a horizontal portion connected with the two parallel portions, wherein the two parallel portions are disposed to the bottom plate and the horizontal portion is disposed to the inner surface. The interference member is disposed between the inner surface and the link member.

3 Claims, 10 Drawing Sheets

BUTTON ASSEMBLY

CROSS-REFERENCE TO RELATED APPLICATION

This application is a divisional application of and claims the priority benefit of U.S. application Ser. No. 16/408,481, filed on May 10, 2019. The prior U.S. application Ser. No. 16/408,481 claims the priority benefits of U.S. provisional application Ser. No. 62/712,993, filed on Aug. 1, 2018, and China application serial no. 201811609150.7, filed on Dec. 27, 2018. The entirety of each of the above-mentioned patent applications is hereby incorporated by reference herein and made a part of this specification.

BACKGROUND

Technical Field

The disclosure relates to a button assembly, and more particularly to a button assembly which reduces noise during use.

Description of Related Art

A keyboard is an input device which is used by punching with fingers. In order to allow the user to use the keyboard flexibly, a link member is usually disposed in the relatively longer button assembly to increase the structural strength of the cap, and the cap may move up and down relative to a bottom plate through the link member. However, when the cap moves up and down, the link member usually collides with the bottom plate and noise is produced. In addition, the junction between the link member and the bottom plate also produces noise due to friction. The problem of noise produced when punching the button assembly is in need for further improvement.

SUMMARY

The disclosure provides a button assembly with reduced noise when being punched.

A button assembly of the disclosure includes a bottom plate, a cap, an elastic member, a link member, and an interference member. The cap is disposed on the bottom plate, and the cap has a button surface and an inner surface on opposite sides. The elastic member is disposed under the cap. The link member has two parallel portions parallel to each other and a horizontal portion connected with the two parallel portions, wherein the two parallel portions are disposed to the bottom plate and the horizontal portion is disposed to the inner surface. The interference member is disposed between the inner surface and the link member.

In an embodiment of the disclosure, the interference member above is disposed on the inner surface.

In an embodiment of the disclosure, the interference member above is disposed on the link member.

In an embodiment of the disclosure, the button assembly further includes a thin film circuit board disposed on the bottom plate, and the thin film circuit board is located under the elastic member.

In an embodiment of the disclosure, the button assembly further includes a support member disposed between the cap and the bottom plate.

A button assembly of the disclosure includes a bottom plate, a cap, an elastic member, and a link member. The cap is disposed on the bottom plate, and the cap has a button surface and an inner surface on opposite sides, wherein the cap has a first interference member and a second interference member, the first interference member and the second interference member are disposed on the inner surface, wherein the interference member and the second interference member respectively has a first accommodating area and a second accommodating area. The elastic member is disposed under the cap. The link member has two parallel portions parallel to each other and a horizontal portion connected with the two parallel portions, wherein the two parallel portions are disposed on the bottom plate and the horizontal portion is disposed in the first accommodating area and the second accommodating area, wherein the first accommodating area has a first central axis, the second accommodating area has a second central axis, and the first central axis and the second central axis are parallel to each other and not coaxial.

In an embodiment of the disclosure, the horizontal portion has a third central axis, and the third central axis is not coaxial with the first central axis nor the second central axis.

A button assembly of the disclosure includes a bottom plate, a cap, an elastic member, and a link member. The cap is disposed on the bottom plate, and the cap has a button surface and an inner surface on opposite sides, wherein the cap has two pairs of interference members disposed on the inner surface and protruding toward the bottom plate. The elastic member is disposed under the cap. The link member has two parallel portions parallel to each other and a horizontal portion connected with the two parallel portions, wherein the two parallel portions are disposed to the bottom plate and the horizontal portion is snapped into the two pairs of interference members, wherein the two pairs of interference members are arranged along the axial direction of the horizontal portion, and one pair of the interference members is offset to the other pair of the interference members along the axial direction of the parallel portion to.

In an embodiment of the disclosure, the button assembly further includes a thin film circuit board disposed on the bottom plate, and the thin film circuit board is located under the elastic member.

In an embodiment of the disclosure, the button assembly further includes a support member disposed between the cap and the bottom plate.

Based on the above, in the button assembly of the disclosure, a more compact contact or even interference with the link member is provided through the configuration of the interference member. Therefore, when the user punches the button assembly, the link member is not easily rotated, so that resonance can be prevented, thereby achieving the effect of noise reduction.

To make the aforementioned and other features of the disclosure more comprehensible, several embodiments accompanied with drawings are described in detail as follows.

DETAILED DESCRIPTION OF DISCLOSED EMBODIMENTS

First Embodiment

Figure 1:
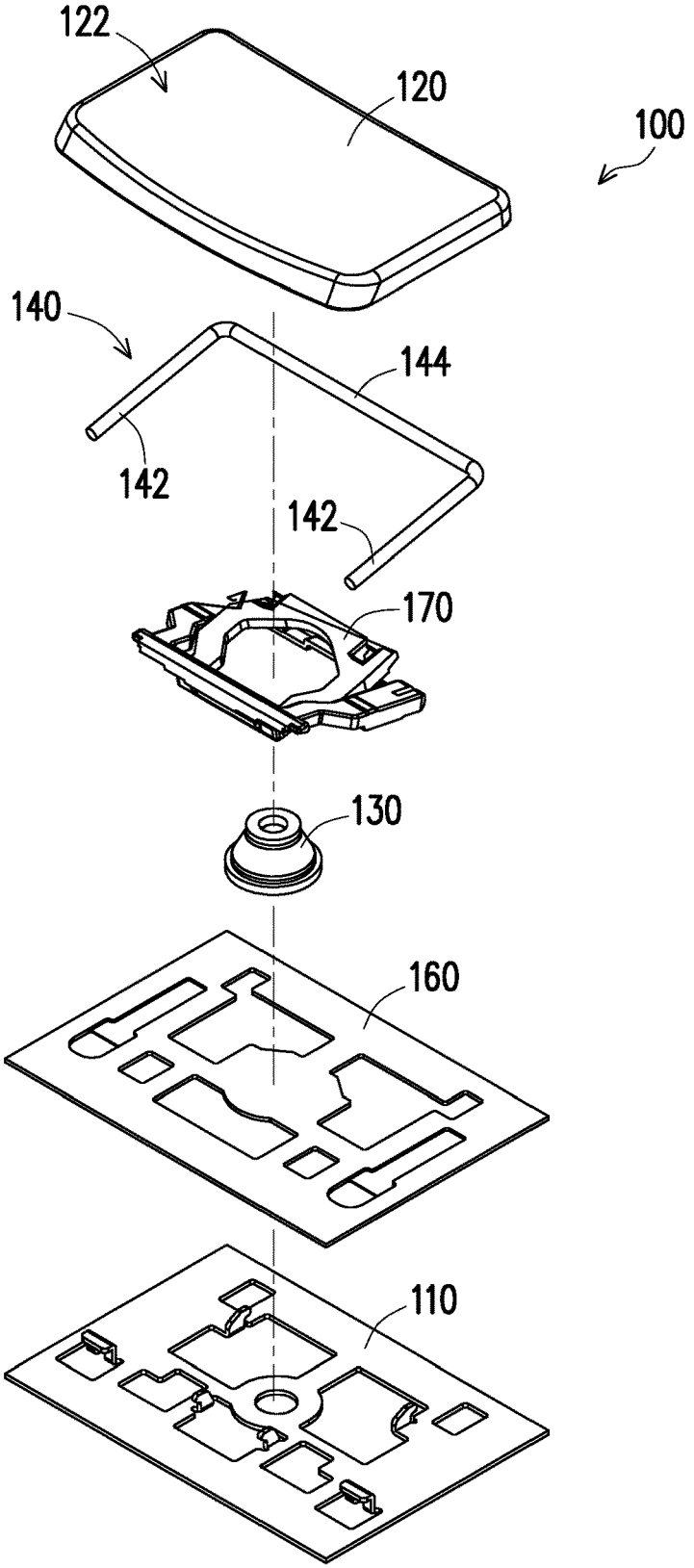
FIG. 1 is an exploded schematic view of a button assembly according to a first embodiment of the disclosure.
Figure 2:
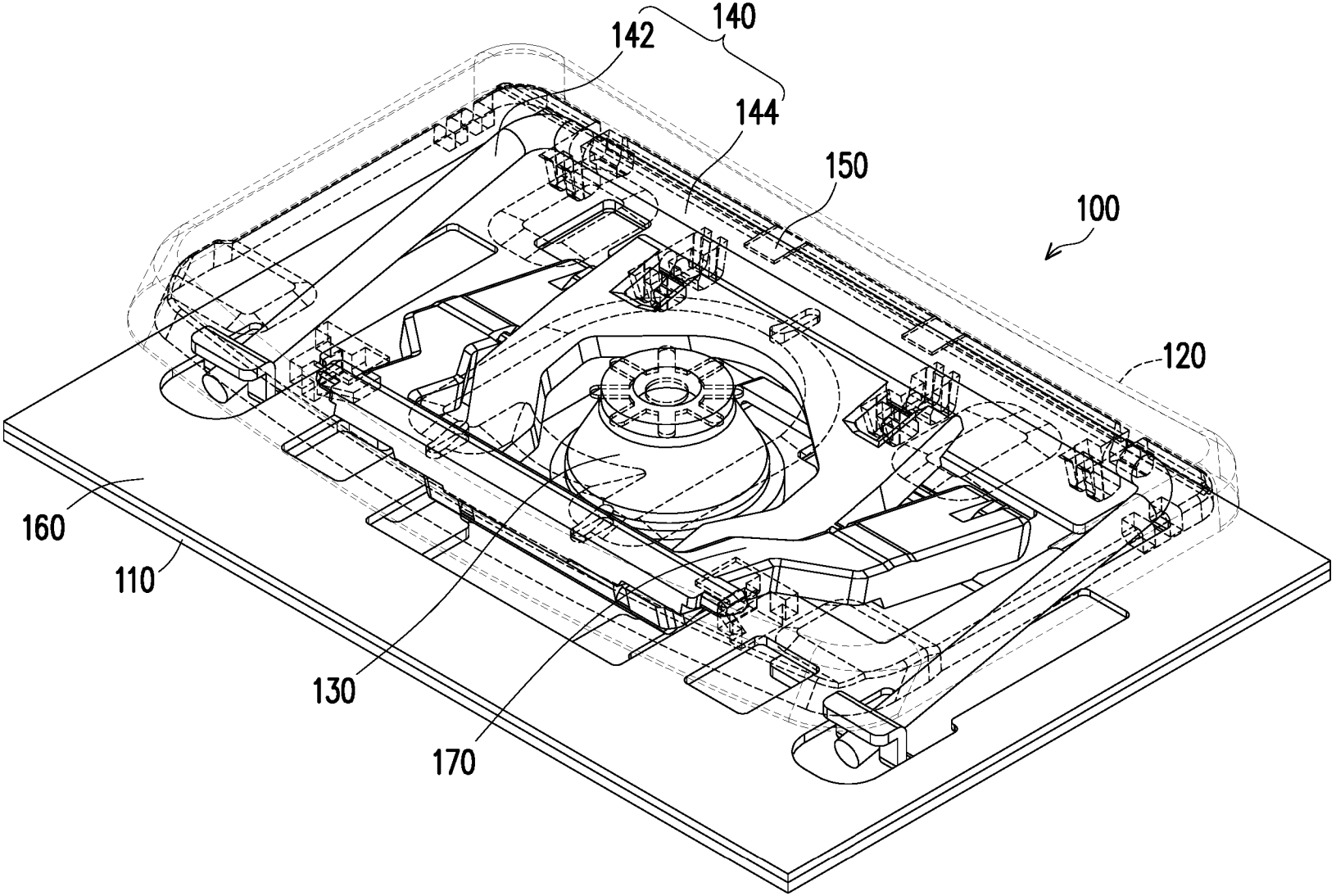
FIG. 2 is an assembly schematic view of the button assembly of FIG. 1.
Figure 3:
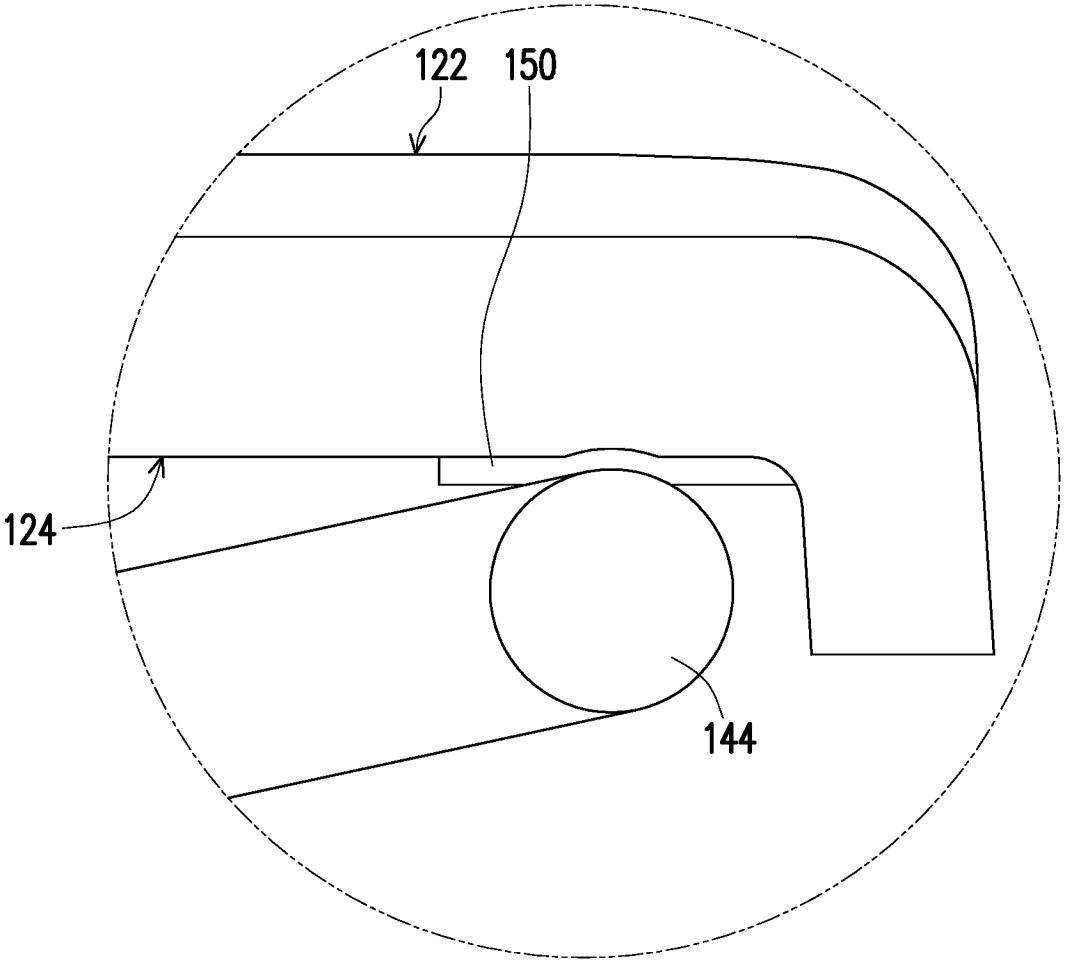
FIG. 3 is an enlarged cross-sectional view of a region A of FIG. 2.

FIG. 1 is an exploded schematic view of a button assembly according to a first embodiment of the disclosure, FIG. 2 is an assembly schematic view of the button assembly of FIG. 1, and FIG. 3 is an enlarged cross-sectional view of a region A of FIG. 2. Please refer to FIG. 1, FIG. 2, and FIG. 3 at the same time. A button assembly 100 of the embodiment includes a bottom plate 110, a cap 120, an elastic member 130, a link member 140, and an interference member 150. The cap 120 is disposed on the bottom plate 110, and the cap 120 has a button surface 122 and an inner surface 124 on opposite sides. The elastic member 130 is disposed under the cap 120. The link member 140 has two parallel portions 142 parallel to each other and a horizontal portion 144 connected with the two parallel portions 142, wherein the two parallel portions 142 are disposed to the bottom plate 110 and the horizontal portion 144 is disposed to the inner surface 124. The interference member 150 is disposed between the inner surface 124 and the link member 140, wherein the interference member 150 is used for causing interference with the inner surface 124 and the link member 140, so as to reduce the vibration due to the rotation of the horizontal portion 144 causing the end of the parallel portion 142 to collide with the bottom plate 110, thereby achieving the effect of noise reduction.

The button assemblies 100 of the embodiment are multiple-width keys, for example keys with relatively larger size corresponding to the Spacebar, the Enter key, the Shift key, the Backspace key, etc. in the keyboard.

Figure 4:
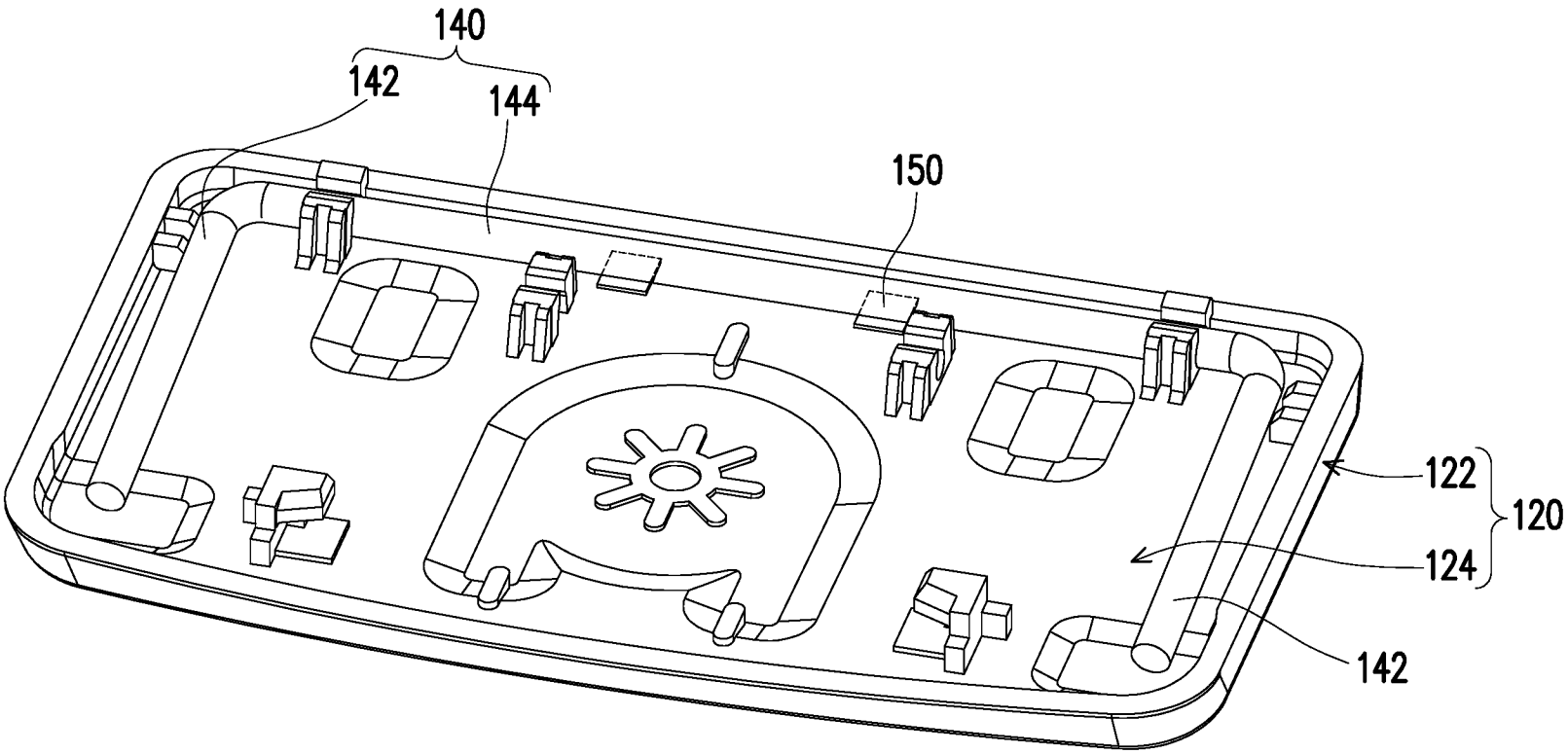
FIG. 4 is a schematic view of an interference member disposed on an inner surface of a cap.

FIG. 4 is a schematic view of an interference member disposed on an inner surface of a cap. Referring to FIG. 2 and FIG. 4 at the same time, in the embodiment, the interference member 150 above is disposed on an inner surface 124 of the cap 120, and the interference member 150 is disposed corresponding to the horizontal portion 144 of the link member 140. The disclosure does not limit the position of the interference member 150, and the interference member 150 may also be disposed corresponding to the parallel portion 142.

From the above, the interference member 150 may be integrally formed on the inner surface 124 of the cap 120 using the method of injection molding when manufacturing the cap 120. Alternatively, the interference member 150 may also be an element independent from the cap 120, such as a plate, disposed on the inner surface 124 via a post-processing method, such as pasting. The material of the interference member 150 may be the same as the material of the cap 120, or the interference member 150 may be manufactured using a material having elasticity.

Continue referring to FIG. 1 and FIG. 2, the button assembly 100 further includes a thin film circuit board 160 disposed on the bottom plate 110, and the thin film circuit board 160 is located under the elastic member 130.

The button assembly 100 may also include a support member 170 disposed between caps and the bottom plate 110 if required. In some magnetic keys, the configuration of the support member 170 may also be omitted.

Continue referring to FIG. 1, FIG. 2, and FIG. 3, when the user punches the cap 120 of the button assembly 100, the user's finger contacts the button surface 122 of the cap 120, the cap 120 is pressured to move downward causing the elastic member 130 to switch on the thin film circuit board 160 for entering a command. At this time, the downward movement of the cap 120 drives the link member 140 to rotate. After the user's finger leaves the cap 120, the elastic restoring force of the elastic member 130 drives the cap 120 to go back to the original position, and the link member 140 is driven by the cap 120 to rotate back to the original position.

In particular, the interference member 150 protrudes from the inner surface 124 of the cap 120, allowing the interference member 150 to maintain interference with the link member 140. Since the end of the parallel portion 142 of the link member 140 is inserted into the bottom plate 110 to be fixed to the bottom plate 110, the link member 140 moves corresponding to the movement of the cap 120, allowing the horizontal portion 144 thereof to use the end of the parallel portion 142 inserted into the bottom plate 110 as the rotational axis to rotate, while the interference member 150 continues to interfere with the link member 140 to reduce the vibration due to the rotation of the horizontal portion 144 causing the end of the parallel portion 142 to collide with the bottom plate 110, thereby achieving the effect of noise reduction.

In addition, the effect of noise reduction with the interference member 150 being disposed corresponding to the horizontal portion 144 of the link member 140 is better as compared to the effect of noise reduction with the interference member 150 being disposed corresponding to the parallel portion 142 of the link member 140. The reason being if when the interference member 150 is disposed at the parallel portion 142, the rotation of the link member 140 is driven by the cap 120 moving up and down, and noise may be easily produced due to the vibration causing the horizontal portion 144 to contact with the inner surface 124 of the cap 120. Therefore, even though noise produced by the collision of the link member 140 with the bottom plate 110 can be reduced, the noise produced by the contact of the horizontal portion 144 with the inner surface 124 cannot be prevented.

However, by disposing the interference member 150 corresponding to the horizontal portion 144, the noise produced by the contact of the horizontal portion 144 with the inner surface 124 and the collision of the link member 140 with the bottom plate 110 can be prevented at the same time. Therefore, the effect of noise reduction is better.

Second Embodiment

This embodiment is substantially the same as the first embodiment above, except that in the first embodiment, the interference member 150 is disposed on the inner surface 124 of the cap 120, while in this embodiment, the interference member 151 is disposed on the link member 140.

Figure 5A:
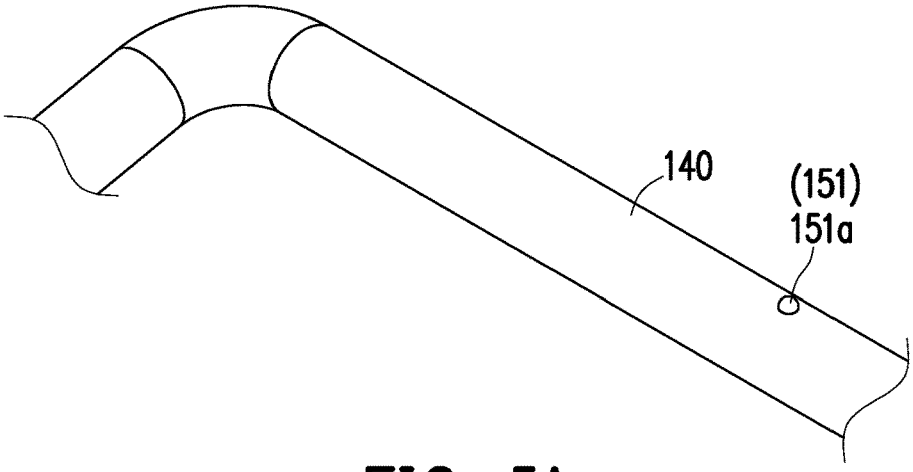
FIG. 5A to FIG. 5C are schematic views of different patterns of an interference member disposed on a link member according to a second embodiment of the disclosure.
Figure 5B:
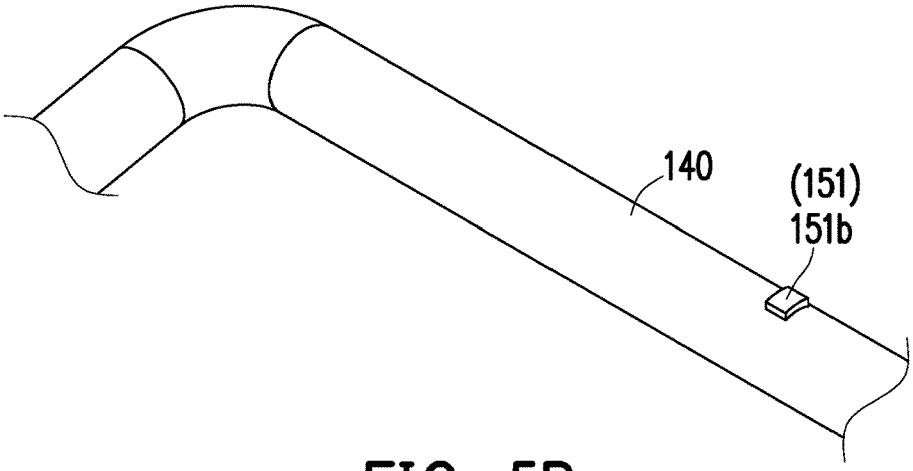
Figure 5C:
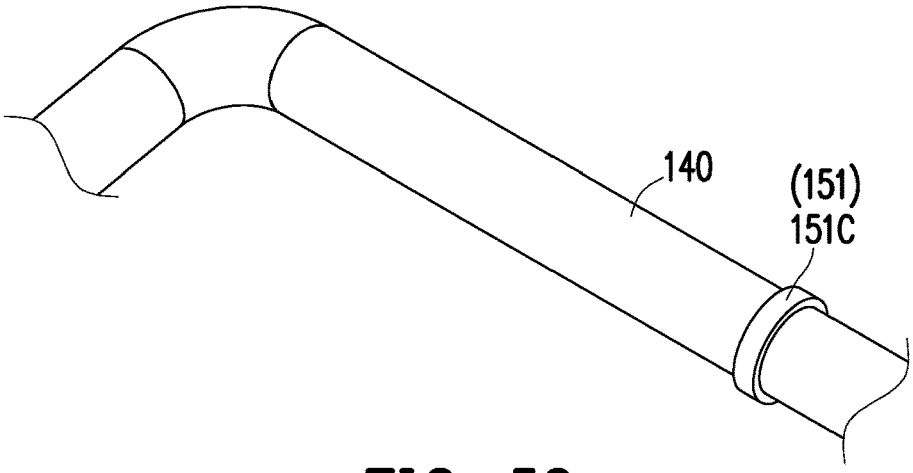

FIG. 5A to FIG. 5C are schematic views of different patterns of an interference member disposed on a link member according to a second embodiment of the disclosure. Specifically, the interference member 151 may be integrally formed on the link member 140. For example, an interference member 151*a* may be formed on the link member 140 using stamping, cutting, or other machining methods at the same time of forming the link member 140, as illustrated in FIG. 5A. For example, the interference member 151 may be a protruding block, a protruding rib, or a protruding strip, depending on usage requirements. In another embodiment, an interference member 151*b* of a different material may also be disposed on the link member 140 using the method of double injection molding, as illustrated in FIG. 5B.

Alternatively, an interference member 151*c* may be a component independent from the link member 140 and may be disposed on the link member 140 (as illustrated in FIG. 5C) via a post-processing method (for example, manual assembly). The interference member 151*c* may be a C-ring or a hollow circular ring.

From the first embodiment and the second embodiment, persons skilled in the art are more easily to conceive that the interference members 150 and 151 may be disposed on the inner surface 124 of the cap 120 and the link member 140 at the same time without affecting the actuation of the button assembly 100, wherein the interference member 150 located at the inner surface 124 may be disposed corresponding to the interference member 151 on the link member 140, or the interference members 150 and 151 may be staggered from each other.

From the above, persons skilled in the art should know that the number, position, shape, and material of the interference members 150 and 151 can be changed according to actual requirements. The goal of noise reduction can be achieved as long as a compact contact with the inner surface 124 of the cap 120 and the link member 140 at the same time can be provided.

Third Embodiment

Figure 6A:
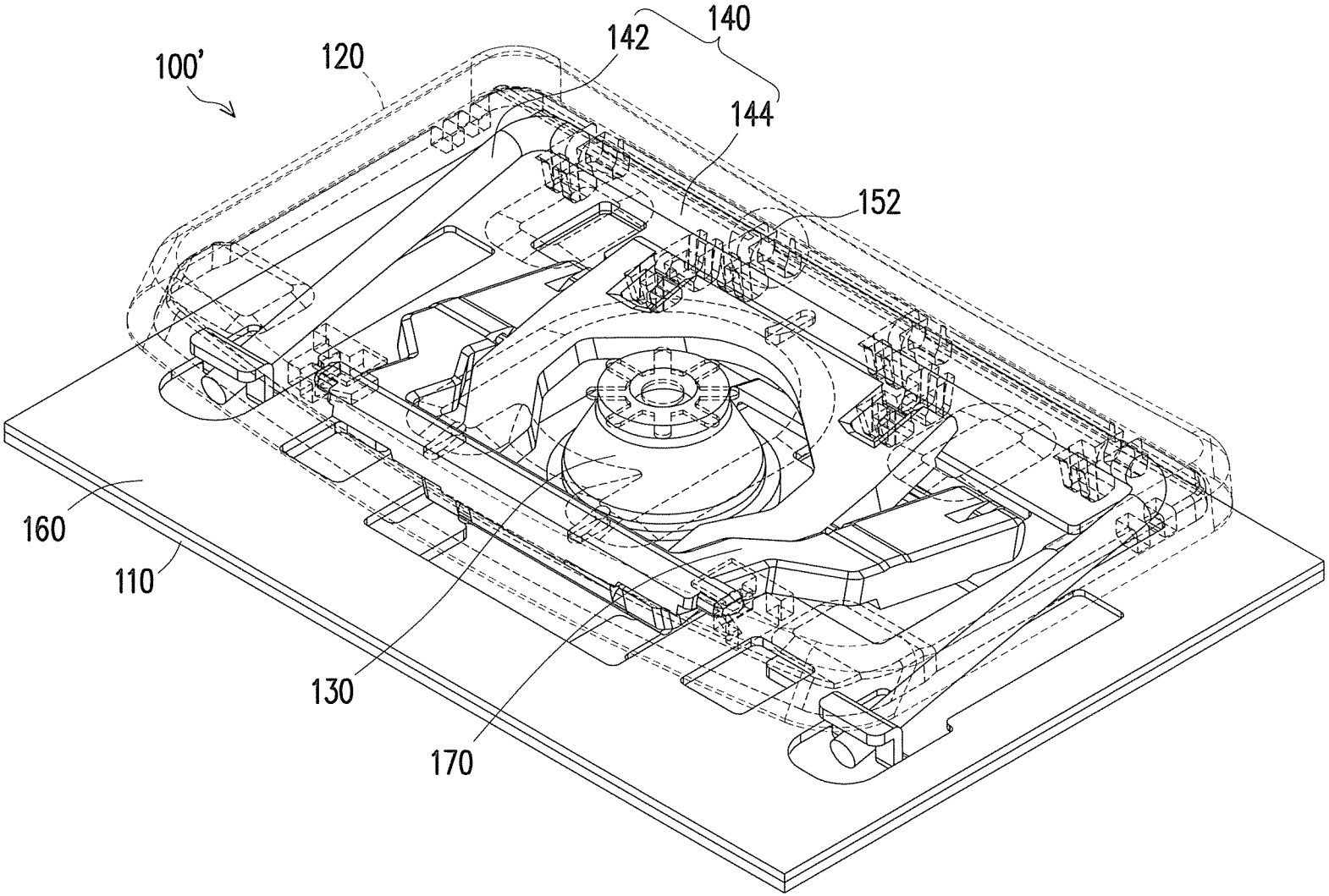
FIG. 6A is an assembly schematic view of a cap, an interference member, and a link member according to a third embodiment of the disclosure.
Figure 6B:
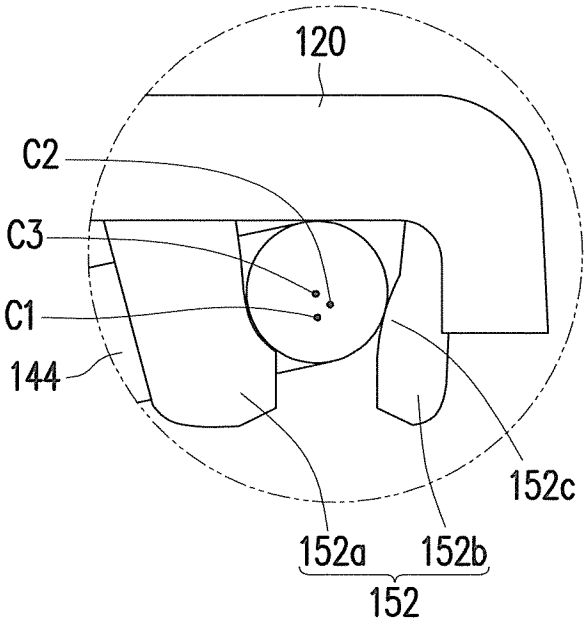
FIG. 6B is an enlarged cross-sectional view of the interference member of FIG. 6A.

FIG. 6A is an assembly schematic view of a cap, an interference member, and a link member according to a third embodiment of the disclosure. FIG. 6B is an enlarged cross-sectional view of the interference member of FIG. 6A. Referring to FIGS. 6A and 6B, this embodiment is substantially the same as the first embodiment and the second embodiment above, except that in a button assembly 100' of this embodiment, the interference member 152 is not disposed between the inner surface 124 of the cap 120 and the link member 140, the interference member 152 is disposed in pairs on the inner surface 124 and protrudes toward the bottom plate 110, and the horizontal portion 144 of the link member 140 is snapped into the interference member 152. Briefly, the interference member 152 further provides a supporting function for fixing and holding the link member 140.

In the embodiment, each pair of interference members 152 has a first interference member 152*a* and a second interference member 152*b*, wherein the first interference member 152*a* has a first accommodating area (not labeled) used for accommodating the link member 140 and the second interference member 152*b* has a second accommodating area (not labeled) used for accommodating the link member 140. Also, a first central axis C1 can be defined from the first accommodating area and a second central axis C2 can be defined from the second accommodating area, wherein the first central axis C1 and the second central axis C2 are parallel but not coaxial.

From the above, the first central axis C1 and the second central axis C2 can be made non-coaxial through allowing the shapes of the first interference member 152*a* and the second interference member 152*b* to be asymmetrical. Specifically, the second interference member 152*b* has a protruding portion 152*c* protruding toward the first interference member 152*a*. Also, when the link member 140 is snapped into the pair of interference members 152, the protruding portion 152*c* slightly shifts the link member 140, allowing the third central axis C3 of the horizontal portion 144 to be non-coaxial with the first central axis C1 of the first interference member 152*a* and also non-coaxial with the second central axis C2 of the second interference member 152*b*. In this way, the goal of reducing the noise produced by the collision of the link member 140 with the bottom plate 110 can be achieved.

Of course, the shapes of the first interference member 152*a* and the second interference member 152*b* may also be symmetrical, wherein the effect of making the second central axis C2 to deviate from the first central axis C1 to be non-coaxial may also be achieved by disposing the protruding portion 152*c* on both the first interference member 152*a* and the second interference member 152*b*.

From the above, the configuration of the protruding portion 152*c* allows the first central axis C1 and the second central axis C2 to be non-coaxial, so that the noise produced by the collision of the link member 140 with the bottom plate 110 can be reduced. In addition, the configuration of the protrusion portion 152*c* further allows the pair of interference members 152 to have a more compact contact or even interference with the link member 140, so that when the button assembly 100' is punched, the vibration frequency of the link member 140 due to rotation can be further reduced, thereby reducing noise caused by resonance.

Fourth Embodiment

Figure 7:
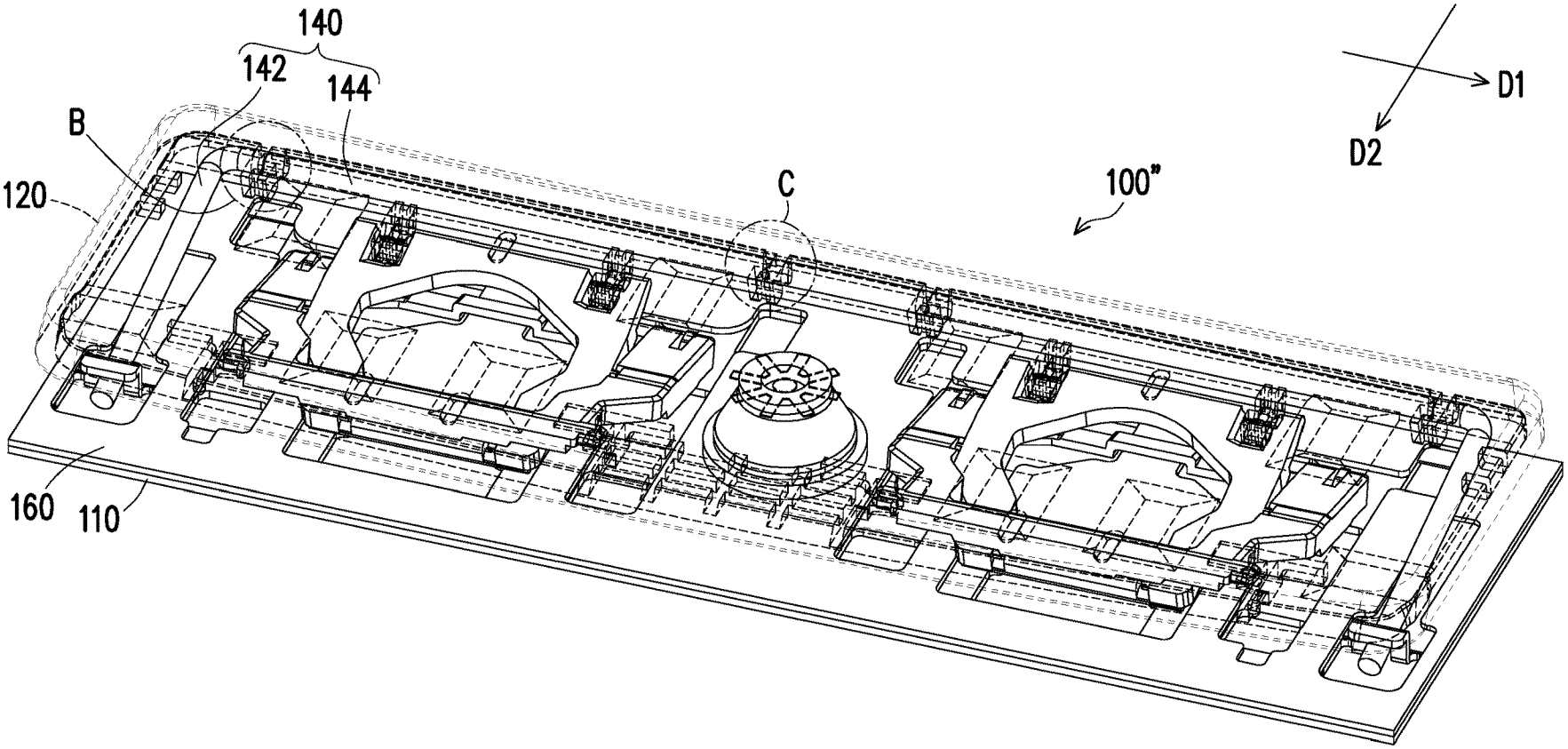
FIG. 7 is a schematic view of a button assembly according to a fourth embodiment of the disclosure.

FIG. 7 is a schematic view of a button assembly according to a fourth embodiment of the disclosure. Referring to FIG. 7, this embodiment is substantially the same as the third embodiment above. The interference members 153 and 154 are formed by a method capable of fixing and holding the link member 140. The difference is that the number of interference members 153 and 154 in this embodiment is more than two pairs, and the shapes of the two interference members 152*a* and 152*b* (labelled in FIG. 6B) of each pair of interference members 153 and 154 are symmetrical to each other. However, the first central axes of at least two pairs of interference members 153 and 154 are not coaxial with each other.

Specifically, among the plurality of pairs of interference members 153 and 154 disposed along the horizontal portion 144 of the link member 140, the position of at least one pair of the interference members 154 is dislocated by the positions of the other pairs of interference members 153.

More specifically, the interference member 153 and the interference member 154 are arranged on an axial direction D1 of the horizontal portion 144, but the interference member 153 and the interference member 154 are dislocated from each other on an axial direction D2 along the parallel portion 142, thereby allowing a central axis C1' of the pair of interference members 154 with the offset configuration to be parallel but not coaxial with the first central axis C1 of the other pairs of interference members 153.

Figure 8A:
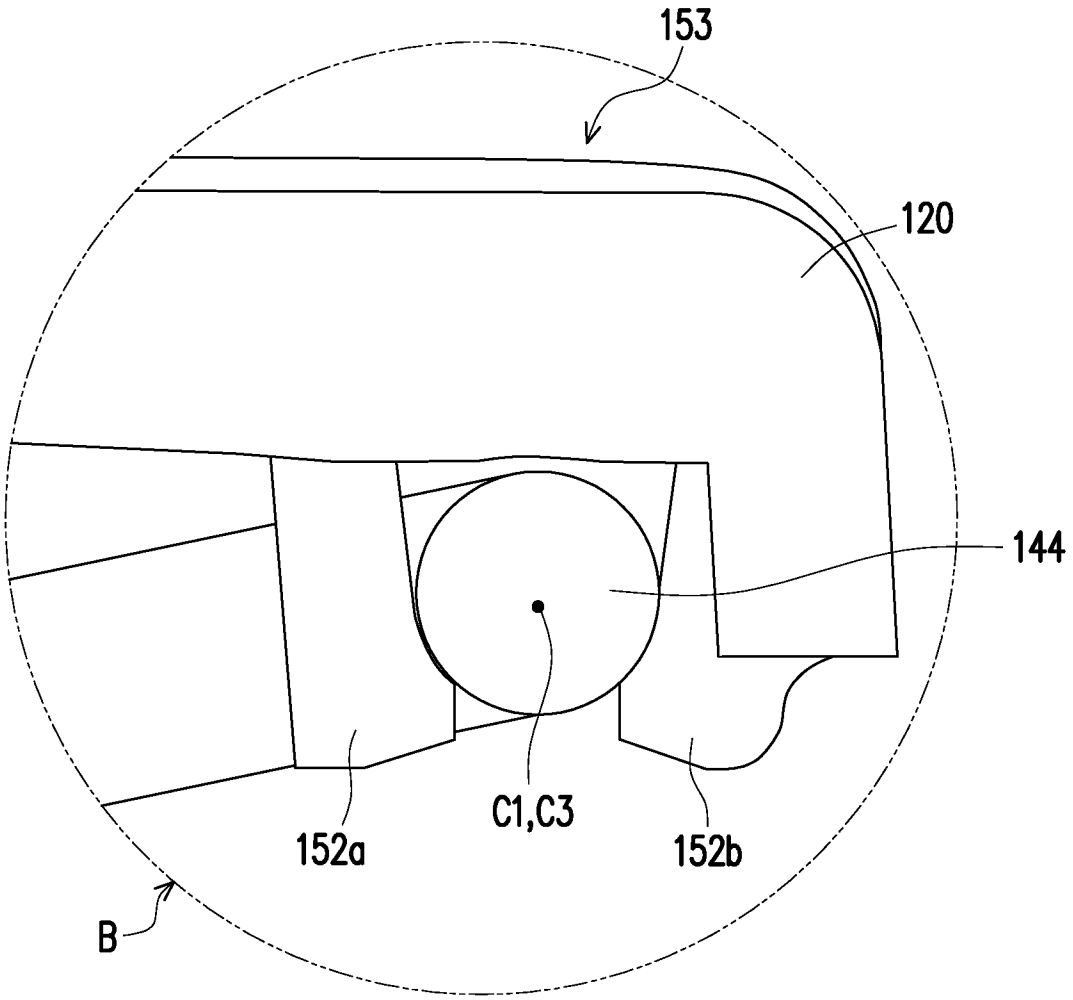
FIG. 8A and FIG. 8B are cross-sectional schematic views of an area B and an area C of FIG. 7.
Figure 8B:
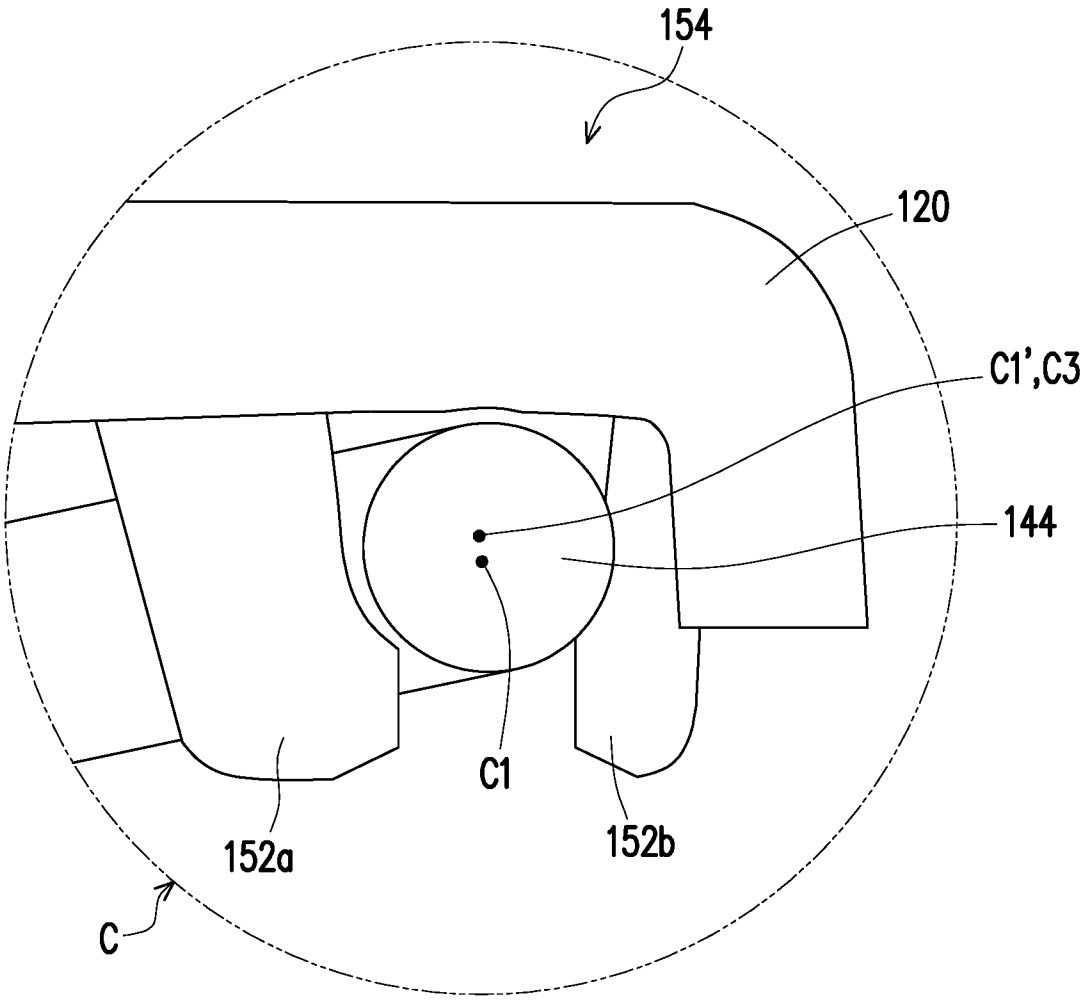

FIG. 8A and FIG. 8B are cross-sectional schematic views of an area B and an area C of FIG. 7. Referring to FIG. 7, FIG. 8A, and FIG. 8B at the same time, after the link member 140 is snapped into these pairs of interference members 153 and 154, it can be observed from FIG. 8A that the third central axis C3 of the horizontal portion 144 at the area B is coaxial with the first central axis C1 of the pair of interference members 153. However, it can be observed from FIG. 8B that since the interference member 154 at the area C and the interference member 153 at the area B are staggered, the horizontal portion 144 of the link member 140 of the interference member 154 engaged at the area C is interfered by the interference member 154, allowing the third central axis C3 to be coaxial with the first central axis C1' of the interference member 154 at the area C, but to deviate from the first central axis C1 of the interference member 153 at the area B, so that the link member 140 does not easily rotate, thereby achieving the goal of noise reduction.

Based on the above, in the button assembly of the disclosure, a compact contact or even interference with the link member is provided through the configuration of the interference member. Therefore, when the user punches the button assembly, the link member does not easily rotate, so that the noise produced by the collision of the link member with the bottom plate or with the cap can be reduced while preventing resonance, thereby effectively achieving the effect of noise reduction.

It may be apparent to those skilled in the art that various modifications and variations may be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A button assembly, comprising:

a bottom plate;

a cap disposed on the bottom plate, the cap having a button surface and an inner surface on opposite sides, wherein the cap has two pairs of interference members disposed on the inner surface and protruding toward the bottom plate;

an elastic member disposed under the cap; and a link member having two parallel portions parallel to each other and a horizontal portion connected with the two parallel portions, wherein the two parallel portions are disposed on the bottom plate and the horizontal portion is snapped into the pair of interference members, wherein the two pairs of interference members are arranged along an axial direction of the horizontal portion, and one pair of the two pairs of interference members is offset along an axial direction of the parallel portion to dislocate from an other pair of the two pairs of interference members, wherein a central axis of the horizontal portion engaged with the one pair of the two pairs of interference members is coaxial with a central axis of the one pair of the two pairs of interference members, the central axis of the horizontal portion engaged with the other pair of the two pairs of interference members is coaxial with a central axis of the other pair of the two pairs of the interference members, and deviates from the central axis of the one pair of the two pairs of interference members.

2. The button assembly according to claim 1, further comprising a thin film circuit board disposed on the bottom plate and located under the elastic member.

3. The button assembly according to claim 1, further comprising a support member disposed between the cap and the bottom plate.

* * * * *